US007914648B2

(12) United States Patent
Chan et al.

(10) Patent No.: US 7,914,648 B2
(45) Date of Patent: Mar. 29, 2011

(54) DEVICE FOR WEB CONTROL HAVING A PLURALITY OF SURFACE FEATURES

(75) Inventors: Vincent Kent Chan, Cincinnati, OH (US); Young Ho Chung, Thousand Oaks, CA (US); Hasan Eroglu, Liberty, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 267 days.

(21) Appl. No.: 12/250,096

(22) Filed: Oct. 13, 2008

(65) Prior Publication Data

US 2009/0151886 A1 Jun. 18, 2009

Related U.S. Application Data

(60) Provisional application No. 61/014,490, filed on Dec. 18, 2007.

(51) Int. Cl.
*D21F 1/00* (2006.01)

(52) U.S. Cl. ..... 162/295; 162/289; 162/361

(58) Field of Classification Search ..... 162/295, 162/289, 361, 272, 275, 274, 193, 202
See application file for complete search history.

(56) References Cited

U.S. PATENT DOCUMENTS

| | | | |
|---|---|---|---|
| 3,206,092 | A | 9/1965 | Sven |
| 3,812,000 | A | 5/1974 | Salvucci et al. |
| 3,994,771 | A | 11/1976 | Morgan, Jr. et al. |
| 4,014,487 | A | 3/1977 | Reba et al. |
| 4,191,609 | A | 3/1980 | Trokhan |
| 4,191,756 | A | 3/1980 | Masi et al. |
| 4,208,459 | A | 6/1980 | Becker et al. |
| 4,300,981 | A | 11/1981 | Carstens |
| 4,321,107 | A | 3/1982 | Page |
| 4,434,957 | A | 3/1984 | Moritz |
| 4,440,597 | A | 4/1984 | Wells et al. |
| 4,514,345 | A | 4/1985 | Johnson et al. |
| 4,528,239 | A | 7/1985 | Trokhan |
| 4,529,480 | A | 7/1985 | Trokhan |
| 4,637,859 | A | 1/1987 | Trokhan |
| 4,906,333 | A | 3/1990 | Myren |
| 5,114,099 | A | 5/1992 | Gao |
| 5,245,025 | A | 9/1993 | Trokhan et al. |
| 5,275,700 | A | 1/1994 | Trokhan |
| 5,328,565 | A | 7/1994 | Rasch et al. |
| 5,334,289 | A | 8/1994 | Trokhan et al. |
| 5,364,504 | A | 11/1994 | Smurkoski et al. |
| 5,411,636 | A | 5/1995 | Hermans et al. |
| 5,518,801 | A | 5/1996 | Chappell et al. |
| 5,527,428 | A | 6/1996 | Trokhan et al. |
| 5,556,509 | A | 9/1996 | Trokhan et al. |
| 5,609,725 | A | 3/1997 | Van Phan |
| 5,628,876 | A | 5/1997 | Ayers et al. |
| 5,629,052 | A | 5/1997 | Trokhan et al. |
| 5,635,031 | A | 6/1997 | Enkvist |

(Continued)

FOREIGN PATENT DOCUMENTS

| | | | |
|---|---|---|---|
| DE | 44 12 939 | C1 | 9/1995 |

(Continued)

*Primary Examiner* — Mark Halpern
(74) *Attorney, Agent, or Firm* — Peter D. Meyer; James E. Oehlenschlager

(57) ABSTRACT

A papermaking apparatus having a machine direction, cross machine direction, and a z-direction. The papermaking apparatus also has a web stabilization device. The web stabilization device has a plurality of surface features that have a feature depth of greater than about 0.02".

20 Claims, 6 Drawing Sheets

U.S. PATENT DOCUMENTS

| | | | |
|---|---|---|---|
| 5,637,194 | A | 6/1997 | Ampulski et al. |
| 5,656,132 | A | 8/1997 | Farrington, Jr. et al. |
| 5,679,222 | A | 10/1997 | Rasch et al. |
| 5,709,775 | A | 1/1998 | Trokhan et al. |
| 5,759,352 | A | 6/1998 | Lau et al. |
| 5,795,440 | A | 8/1998 | Ampulski et al. |
| 5,865,950 | A | 2/1999 | Vinson et al. |
| 5,888,349 | A | 3/1999 | Lau et al. |
| 5,891,309 | A | 4/1999 | Page et al. |
| 5,900,122 | A | 5/1999 | Huston |
| 5,906,710 | A | 5/1999 | Trokhan |
| 5,935,381 | A | 8/1999 | Trokhan et al. |
| 5,938,893 | A | 8/1999 | Trokhan et al. |
| 5,942,085 | A | 8/1999 | Neal et al. |
| 5,967,457 | A | 10/1999 | Wildenberg et al. |
| 6,039,842 | A | 3/2000 | Lau et al. |
| 6,048,938 | A | 4/2000 | Neal et al. |
| 6,187,138 | B1 | 2/2001 | Neal et al. |
| 6,325,896 | B1 | 12/2001 | Hultcrantz et al. |
| 6,375,801 | B2 | 4/2002 | McGary et al. |
| 6,394,651 | B2 | 5/2002 | Jackson |
| 6,394,652 | B2 | 5/2002 | Meyer et al. |
| 6,547,928 | B2 | 4/2003 | Barnholtz et al. |
| 6,558,514 | B2 | 5/2003 | Rouhiainen et al. |
| 2002/0092637 | A1 | 7/2002 | Rouhiainen et al. |
| 2004/0192136 | A1 | 9/2004 | Gusky et al. |
| 2005/0161185 | A1 | 7/2005 | Weigant et al. |

FOREIGN PATENT DOCUMENTS

| | | | |
|---|---|---|---|
| EP | 0 452 284 | A2 | 10/1991 |
| EP | 0 677 612 | A2 | 10/1995 |
| WO | WO 96/00812 | | 1/1996 |
| WO | WO 03/018909 | A | 3/2003 |

DEVICE FOR WEB CONTROL HAVING A PLURALITY OF SURFACE FEATURES

CROSS-REFERENCE TO RELATION APPLICATION

This application claims the benefit of provisional U.S. Application No. 61/014,490, filed Dec. 18, 2007.

FIELD OF THE INVENTION

This invention relates to a foil for use in a papermaking apparatus wherein the foil provides stabilization, while providing a relative low amount of drag, to a paper web as the paper web passes the foil.

BACKGROUND OF THE INVENTION

During the manufacturing of a paper web, the moving web, such as one that may be used as the substrate for a paper towel or tissue towel, is transported at very high velocities. In many instances, the web is transported without support and this may result in the web 'fluttering' or otherwise losing control.

Those of skill in the art may appreciate that flutter is undesirable because flutter is thought to be a contributing cause of tearing that may occur in the paper web. Further, flutter in the web often forces producers to reduce the velocity at which the paper web is transported, causing decreases in efficiency and incurring additional costs.

One method available in the prior art to address the problem of sheet flutter is through the use of stabilizing devices, such as a foil. The foils described in the prior art may be used either in converting processes/apparatus or in papermaking processes/apparatus. The foil may be used to act as a guide for the traveling web in order to reduce or eliminate flutter. However, a problem that those of skill in the art will appreciate exists with many of the prior art foils is that the foil, while stabilizing the web, may cause drag on the surface of the web. Drag may be detrimental to a traveling paper web, especially a relatively light paper web, because it is thought that drag may cause tearing or other mechanical failures in the paper web. In some instances, the velocity of a paper web in a papermaking operation may require special design considerations due to the relatively high velocity that a paper web in the paper making operation.

As a result, there exists the need for a web stabilizing device that exerts a relatively low amount of drag on a moving paper web. It was surprisingly discovered that by providing a plurality of discrete features in the surface of a foil, the amount of drag caused by the foil was reduced relative to the drag caused by a foil of the prior art.

SUMMARY OF THE INVENTION

In one embodiment, the present invention is directed to a papermaking apparatus comprising a machine direction, cross machine direction, and a z-direction, the apparatus further comprising: a web stabilization device, wherein the web stabilization device comprises a plurality of surface features; wherein the surface features have a feature depth of greater than about 0.020".

In another embodiment, the present invention is directed to a web stabilization device wherein the web stabilization device comprises a first surface and a second surface, and wherein the web stabilization device further comprises a plurality of surface features having a feature depth of greater than about 0.020".

In another embodiment still, the present invention is directed to a web stabilization device wherein the web stabilization device provides a test system wall shear stress (lb/in$^2$) of less than about:

$$\text{Wall Shear Stress}=(5\times10^{-7})(\text{Web velocity})-5\times10^{-4}$$

to an adjacent web with a web velocity of from about 2000 FPM to about 6000 FPM.

BRIEF DESCRIPTION OF THE DRAWINGS

While the specification concludes with claims that particularly point out and distinctly claim the present invention, it is believed that the present invention will be understood better from the following description of embodiments, taken in conjunction with the accompanying drawings, in which like reference numerals identify identical elements.

Without intending to limit the invention, embodiments are described in more detail below.

DETAILED DESCRIPTION OF THE INVENTION

Definitions

Figure 1:
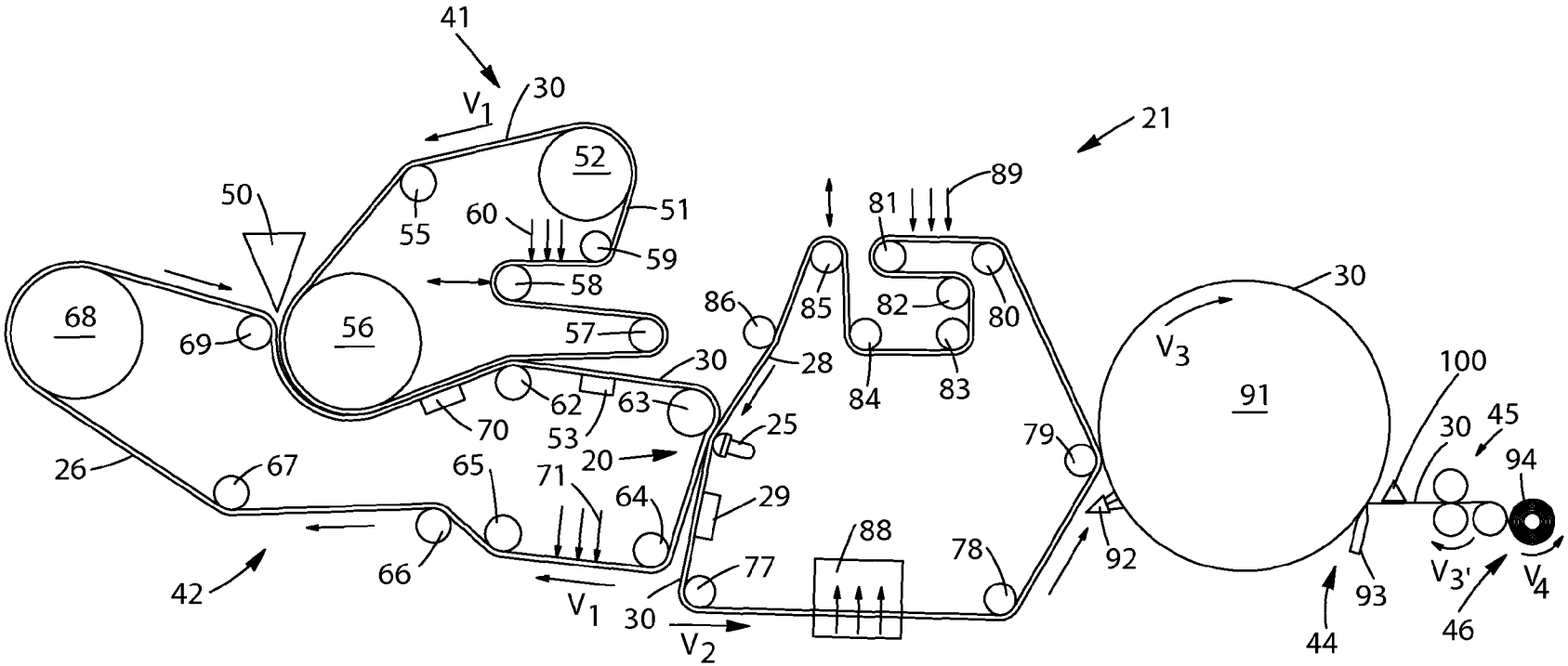
FIG. 1 is a schematic view of an exemplary paper making apparatus according to the present invention.

As used herein, "fibrous structure" means an arrangement of fibers produced in any papermaking machine known in the art to create a ply of paper. "Fiber" means an elongate particulate having an apparent length exceeding its apparent width. More specifically, and as used herein, fiber refers to such fibers suitable for a papermaking process.

As used herein, "paper product" refers to any formed, fibrous structure products, traditionally, but not necessarily, comprising cellulose fibers. In one embodiment, the paper products of the present invention include bath tissue products.

As used herein, "conventional paper web" refers to a paper web which has not been textured by a papermaking belt, wire, fabric, and the like during the papermaking process. In one embodiment, conventional paper web refers to a paper web which has been dried only by contact with the Yankee dryer. In another embodiment, a conventional paper web does not have any texture imparted onto the surface, although it may be textured during a converting process.

As used herein, "ply" or "plies" means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the layers may or may not be homogenous within a layer. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

As used herein, "basis weight" or "BW" is the weight per unit area of a sample reported in lbs/3000 $ft^2$ or $g/m^2$.

As used herein, "caliper" or "sheet caliper" is the macroscopic thickness of a product sample under load.

As used herein, "machine direction" or "MD" refers to the direction parallel to the flow of the fibrous structure through the papermaking machine and/or product manufacturing equipment.

As used herein, "cross machine direction" or "CD" refers to the direction perpendicular to the machine direction in the same plane of the fibrous structure and/or fibrous structure product comprising the fibrous structure.

As used herein, "z-direction" refers to the direction normal to a plane formed by machine direction and cross machine directions.

As used herein, "paper-making apparatus" or "paper-making equipment" or "paper-making machinery" refers to the apparatus, equipment and/or machinery that may be used to provide a web of paper product from a slurry of fibers. An exemplary paper-making apparatus is described infra. In one embodiment, a papermaking apparatus runs at, or above, about 3200 FPM. In another embodiment, a papermaking apparatus runs from about 3200 FPM to about 8000 FPM. In another embodiment, a papermaking apparatus runs from about 3800 FPM to about 4500 FPM.

As used herein, "converting apparatus" or "converting equipment" or "converting machinery" refers to the apparatus, equipment, and/or machinery that may be used to perform a converting operation (i.e., embossing, printing, lamination, etc.) after the paper has been made by a paper-making apparatus/equipment/machinery. Those of skill in the art may appreciate that converting apparatus typically runs at, or below, about 2500 FPM which is relatively slow compared to a papermaking apparatus which typically runs at, or above, about 3200 FPM. Thus, without wishing to be limited by theory, one of skill in the art may appreciate that because of the speed differential, a web-stabilization device which may be used in a converting apparatus may not be suitable for a web-stabilization device which may be used in a papermaking apparatus due to the mechanical operations that a converting apparatus performs. However, one of skill in the art will appreciate that the ability of a single type of web-stabilization device in both the papermaking and converting apparatus will lead to improved efficiency (since only one interchangeable part will be required) and lower costs.

As used herein, "web-stabilization device" or "web-stabilizing device" refers to a web handling element that may be used to stabilize a moving web. In some embodiments, a web-stabilizing device may be used in either a papermaking and/or converting process. In other embodiments, a web-stabilizing device may be used in conjunction with any web product, described infra. A web stabilization device may be passive and operate by relying on local forces (i.e., the Bernoulli effect) to attract a moving web towards the web-stabilizing device and thereby reduce flutter in, and thus stabilize, the paper web. Alternatively, a web stabilizing device may be active in that it might use compressed air or a vacuum in addition to the device alone to stabilize the paper web. Exemplary prior art web stabilization devices are exemplified in U.S. Pat. Nos. 6,375,801 and 5,891,309 and U.S. Pat. App. Pub. No. 2005/0161185A1. In some embodiments, a "web-stabilization device" may be referred to as a "foil" or an "airfoil."

As used herein, "surface feature" refers to a structured element on the surface of a web-stabilization device or foil. In one embodiment, a surface feature is a recessed area on the surface of the web-stabilization device or foil. In another embodiment, a surface feature is a raised element on the surface of the web-stabilization device or foil. A surface feature may be either discrete, continuous, or semicontinuous. A surface feature may be introduced on the surface of a web-stabilization device or foil by any means known in the art. Exemplary materials having surface features are described in U.S. Pat. Nos. 5,114,099 and 4,434,957. Further, materials that may be used to provide a web-stabilization device or foil of the present invention are commercially available from Rimex Metals Inc. (Edison, N.J.), Mechanical Metals Inc. (Newtown, Pa.), and Rigidized Metals (Buffalo, N.Y.).

Paper Product

The present invention contemplates the use of a variety of paper making fibers, such as natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded.

Other materials are also intended to be within the scope of the present invention as long as they do not interfere or counteract any advantage presented by the instant invention.

The paper product may comprise any tissue-towel paper product known in the industry. Embodiment of these substrates may be made according U.S. Pat. Nos. 4,191,609, 4,300,981, 4,514,345, 4,528,239, 4,529,480, 4,637,859, 5,245,025, 5,275,700, 5,328,565, 5,334,289, 5,364,504, 5,527,428, 5,556,509, 5,628,876, 5,629,052, 5,637,194, and 5,411,636; EP 677612, and U.S. Pat. App. No. 2004/0192136A1.

The substrates used to make the present invention paper product may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. Nos. 6,048,938, 5,942,085, 5,865,950, 4,440,597, 4,191,756, and 6,187,138.

Conventionally pressed paper and a method for making such is described infra and is also exemplified in U.S. Pat. No. 6,547,928. Uncompacted, non pattern-densified paper products are also contemplated within the scope of the present invention and are described in U.S. Pat. Nos. 3,812,000 and 4,208,459. Uncreped paper products as defined in the art are also contemplated. The techniques to produce uncreped paper products in this manner are exemplified in European Pat. App. Nos. 0 677 612A2 and 0 617 164 A1; and in U.S. Pat. No. 5,656,132.

Uncreped paper product, in one embodiment, refers to a paper product which is non-compressively dried. In one embodiment, an uncreped paper product is dried by through air drying. Resultant through air dried paper products may be pattern densified such that zones of relatively high density are dispersed within a high bulk field, including pattern densified tissue wherein zones of relatively high density are continuous and the high bulk field is discrete. The techniques to produce uncreped paper product in this manner are taught in the prior art. For example, Wendt, et. al. in European Pat. App. Nos. 0 677 612A2 and 0 617 164 A1; and U.S. Pat. No. 5,656,132

The substrate which comprises the paper product of the present invention may be cellulosic, or a combination of both cellulose and non-cellulose. The substrate may be conventionally dried using one or more press felts. If the substrate which comprises the paper product according to the present invention is conventionally dried, it may be conventionally dried using a felt which applies a pattern to the paper as taught by commonly assigned U.S. Pat. No. 5,556,509; and PCT App. No. WO 96/00812. Other exemplary paper products may be made according to U.S. Pat. Nos. 4,528,239, 4,529,480, 5,275,700, 5,364,504, 5,527,428, 5,609,725, 5,679,222, 5,709,775, 5,795,440, 5,900,122, 5,906,710, 5,935,381, and 5,938,893.

Web Product

In some embodiments, a web material can be produced from a papermaking machine or the like. Nonlimiting exemplary web materials may be selected from the group consisting of: polymeric films, fabric, cloth, metal films, nonwovens, airlaid products, the like, and combinations thereof.

As described supra, in some embodiments, the web material may be made of polymeric materials. For example, flexible films, particularly those made of comparatively polymeric materials, have been widely employed for the protection and preservation and containment of various items and materials. Additionally, web materials having modified properties to provide a desired resistive force to an applied elongation force on the web are generally known. Such web materials are described in U.S. Pat. Nos. 5,518,801; 6,394,651; and 6,394,652.

In some other embodiments, the web material may be a laminate web. Laminate webs formed by the joining of discrete webs in a layered relationship are well known in the art. For example, often laminate nonwoven webs are utilized in disposable absorbent articles such as diapers and adult incontinence products. Such laminated webs can be used as a topsheet, backsheet, or side panels. One example of a laminate web is a film/nonwoven laminate useful for a stretch side panel of a disposable diaper. Nonwoven/nonwoven laminates are also utilized to provide additional bulk or softness to a web component. Likewise, film/film laminate webs can provide benefits by combining the characteristics of various films in a layered relationship. Laminate webs can also be called composite webs.

Less common examples of laminate webs include laminates of dissimilar materials. The materials may be dissimilar in mechanical tensile properties, thermal properties, or visual/tactile properties. For example, a nonwoven web may be joined to a relatively stiff fabric to provide for a soft surface feel to the fabric. The dissimilar materials may be joined by melt bonding, adhesive bonding, ultrasonic bonding, and the like. Bonding methods are often determined by the materials themselves, but often require adhesive bonding. For example, a laminate or composite of materials having widely differing melt properties may require an adhesive layer between laminate layers. Even materials having similar melt properties, such as nonwoven and thermoplastic film materials are often joined by adhesive for adequate bonding to prevent unwanted delamination. Such processing methods can be expensive due to the addition of adhesive, and the resulting laminate is often relatively stiff, depending on the level of adhesive added.

Apertured laminate webs can be made by methods in the art. One beneficial method of aperturing a nonwoven web, for example, is disclosed in commonly-assigned U.S. Pat. No. 5,916,661.

Paper Making Apparatus

FIG. 1 shows a schematic view of an exemplary paper making apparatus 21 in which the web-stabilization device of the present invention may be used. The papermaking machine 21 comprises a transfer zone 20 and a forming section 41, an intermediate carrier section 42, a pre-dryer/imprinting section 43, a drying/creping section 44, a calendar assembly 45, and reel 46.

The forming section 41 of the paper machine 21 comprises a headbox 50; a loop of fine mesh backing wire or fabric 51 which is looped about a vacuum breast roll 52, over vacuum box 70, about rolls 55 through 59, and under showers 60. Intermediate rolls 56 and 57, backing wire/fabric 51 is deflected from a straight run by a separation roll 62. Biasing means not shown are provided for moving roll 58 as indicated by the adjacent arrow to maintain fabric/wire 51 in a slack obviating tensioned state.

The intermediate carrier section 42 comprises a loop of forming and carrier fabric 26 which is looped about rolls 62 through 69 and about a portion of roll 56. The forming and carrier fabric 26 also passes over vacuum boxes 70 and 53, and transfer head 25; and under showers 71. Biasing means are also provided to move roll 65 to obviate slack in fabric 26. Juxtaposed portions of fabrics 51 and 26 extend about an arcuate portion of roll 56, across vacuum box 70, and separate after passing over an arcuate portion of separation roll 62. In one embodiment, forming and carrier fabric 26 is identical to backing wire/fabric 51 except for the lengths.

The pre-dryer/imprinting section 43 of paper machine 21 comprises a loop of transfer fabric or imprinting fabric 28. Transfer/imprinting fabric 28 is looped about rolls 77 through 86; passes across transfer head 25 and vacuum box 29; through a blow-through pre-dryer 88; and under showers 89. Additionally, not shown is a biasing mechanism for biasing roll 79 towards the adjacent Yankee dryer 91 with a predetermined force per lineal inch to effect imprinting the knuckle pattern of fabric 28 in web 30 in the manner of, and for the purpose disclosed in, U.S. Pat. No. 3,301,746. Not shown is a biasing mechanism for moving roll 85 as indicated by the adjacent arrow to obviate slack in fabric 28.

The drying/creping section 44 of paper machine 21 comprises Yankee dryer 91, adhesive applicator 92, creping blade 93, and reel roll 94. A web stabilizing device 100 according to the present invention may be installed between the creping blade 93 and the calendar assembly 45. In some embodiments, the web stabilizing device 100 may be juxtaposed adjacent to the web 30. In other embodiments, the web stabilizing device 100 may be juxtaposed adjacent to, and above (in the Z-direction), the web 30. One of skill in the art may appreciate that a web stabilization device 100 does not necessarily have to be positioned between the creping blade 93 and the calendar assembly, but may be positioned anywhere in the papermaking apparatus where the user may require web stabilization.

$V_1$ is the velocity of the papermaking fabrics 51 and 26. $V_2$ is the velocity about the transfer/printing rolls 77 through 86. $V_3$ is the velocity of the calendar assembly 45. $V_4$ is the reel velocity of the reel roll 94.

Web Stabilization Device

The web stabilization device of the present invention can be made from any material or materials suitable for the particular purpose of the device, whether the material(s) is now known or later becomes known. For example, a web stabilization device may be made from a material selected from the group consisting of: stainless steel, carbon steel, alloy metals, aluminum, aluminum alloys, composite materials, fiberglass, epoxy based, multi-bonded materials, carbon fibers, woven and/or bonded materials, cured and/or baked materials, plastics, and combinations thereof.

Figure 2:
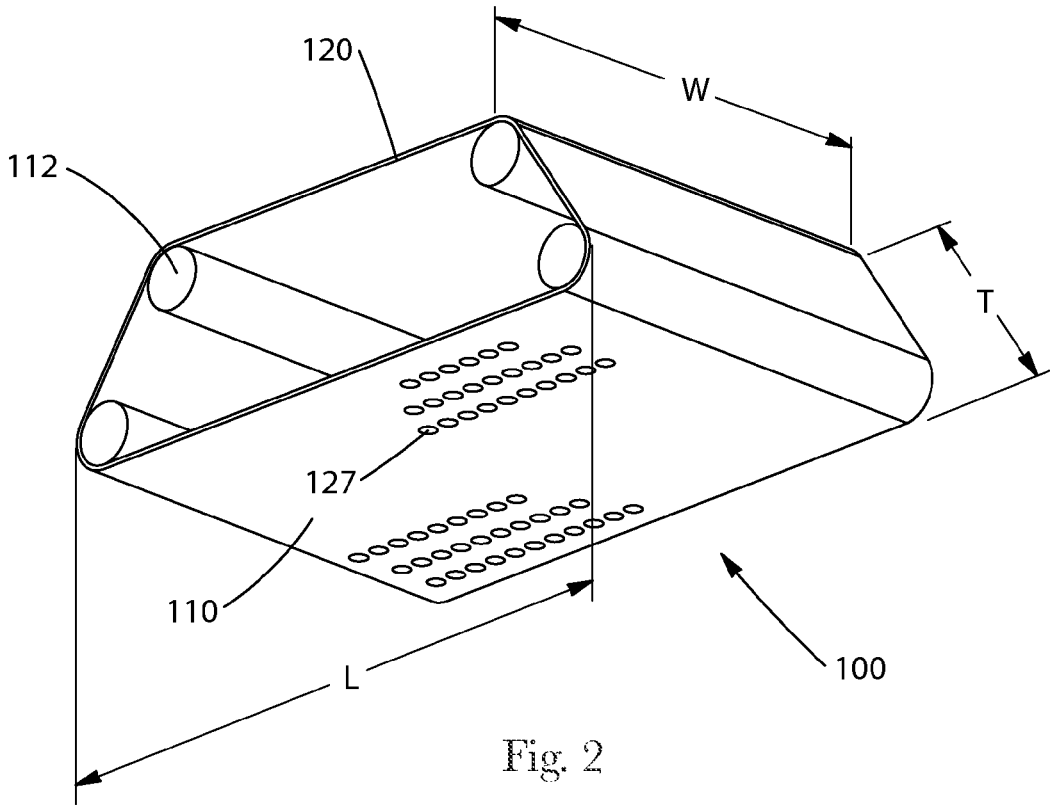
FIG. 2 is a perspective view of an exemplary web stabilization device according to the present invention.

FIG. 2 shows a perspective view of an exemplary embodiment of the present invention web-stabilization device. In the exemplary embodiment, the web-stabilization device 100 comprises a first surface 110 and a second surface 120. In the exemplary embodiment, the first surface and second surface are juxtaposed such that the first surface 110 and second surface 120 are in a substantially axially parallel configuration. One of skill in the art may appreciate that a web-stabilization device 100 may be provided with any dimensions that are suitable for the specific application or apparatus with which the web stabilization device is to be used. In particular, because it is thought that only a surface having a plurality of surface features is required to provide suitable stabilization to a moving web, the web stabilization device may comprise a single panel wherein the first surface 110 and second surface 120 are the opposite faces of the same panel. The web stabilization device 100 may have any thickness T that may be practical or suitable for the intended purpose. In one embodiment, the thickness is from about ½" to about 15". In one embodiment, the web stabilization device 100 has a length, L, of from about 2" to about 600". In another embodiment, the length is from about 24" to about 120". In one embodiment, the web stabilization device has a width of from about 4" to about 250" inches.

In the exemplary embodiment shown in FIG. 2, the web stabilization device 100 comprises a plurality of support frame elements 112 on which sheets of solid material (for example, a textured metal, fiberglass, carbon fiber, and the like) may be mounted using any means known in the art. The web stabilization device 100 further comprises a plurality of surface features 127. In one embodiment, the surface features 127 are on the outward-facing sides of the first surface 110 and/or the second surface 120. In another embodiment, the surface features 127 are on the face of the web stabilization element 100 that is adjacent to the moving paper web during operation in a paper making apparatus. In some embodiments, the first surface 110 of the web stabilization device is not flat, but may have a slight curvature. In one embodiment, the first surface 110 is concave. In another embodiment, the first surface 110 is convex. In one embodiment, the maximum offset distance, $D_{offset}$, for a curved surface is from about 1/16" to about 4". The maximum offset distance is the furthest distance (positive or negative z-direction) out of the MD-CD plane which the first surface may extend.

Web Stabilization Device: Textured Surface

Figure 3:
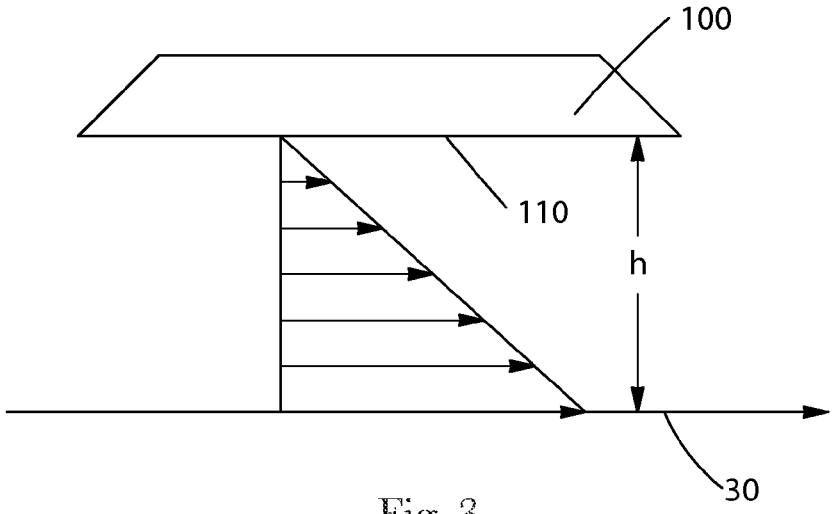
FIG. 3 is a schematic view of an exemplary web stabilization device according to the present invention juxtaposed adjacent to a moving paper web.

It is thought that drag may be caused by actual contact with the surface and from other forces. Without wishing to be limited by theory, it is thought that flow between a moving web and a web stabilization device may be described as Couette flow. One of skill in the art may appreciate that Couette flow may be described as having a linear velocity profile for a relatively small space S between two objects (i.e., moving web 30 and web stabilization device 100 comprising a first surface 110) as is shown in FIG. 3. In some embodiments, the average space, or gap height, h, between the moving web 30 and the web stabilization device 100 is from about 0.001" to about 0.04".

Surprisingly, it was discovered that when a web stabilization device 100 comprising a plurality of surface features 127 is used instead of a web stabilization device having no surface features (i.e., is smooth), there was a reduction in drag on the moving web 30. Without wishing to be limited by theory, it is thought that a web stabilization device 100 with surface features provides a controlled space between the device 100 and a moving web 30 which controls the aerodynamic elements of drag force. Those of skill in the art may appreciate that depending on gap height a boundary layer may form and form a free stream flow between the web stabilization device 100 and the moving web 30 at relatively large gaps.

It is thought that when the surface of a web stabilization device 100 is used to support an adjacent moving web 30 there is always a certain amount of spacing or some amount of fluid (i.e., air) that is between the web stabilization device 100 and the moving web 30, despite a high level of smoothness and planarity of the web stabilization device 100. Further, one of skill in the art may appreciate that a combination of the mechanical frictional force and the direct aerodynamic shear on the web surface create the total drag force on the web.

Further, one of skill in the art may appreciate that drag force increases with velocity. Without wishing to be limited by theory, it is thought that the relationship between the suction force (of which mechanical drag force is a function) exerted on a moving web and an adjacent object, such as a web-stabilization device, is directly proportional to the velocity of the moving web.

$$F_{suction} \propto \tfrac{1}{2} A \rho V^b$$

Where $F_{suction}$ is the suction force, A is the area of the web, V is the web velocity, and ρ is the density of the fluid medium, and b=2 for second order velocity.

The aerodynamic drag force also is proportional to velocity for Couette flow $$D = A\mu u/h.$$

Where D is the aerodynamic drag force, A is the area of the web, μ is the dynamic viscosity of air, u is the velocity of the web and h is the gap height.

The use and design of non-smooth surfaces to reduce the drag forces exerted on a moving object in a fluid medium is known in the art. Exemplary non-smooth surfaces are described in U.S. Pat. Nos. 5,114,099 and 4,434,957. It was surprisingly discovered that by providing surface features to the face of the web stabilization device in the papermaking section of a paper machine, the amount of drag exerted onto the moving web is dramatically reduced, in both the converting apparatus and in the relatively high velocities of a papermaking apparatus.

Figure 4A:
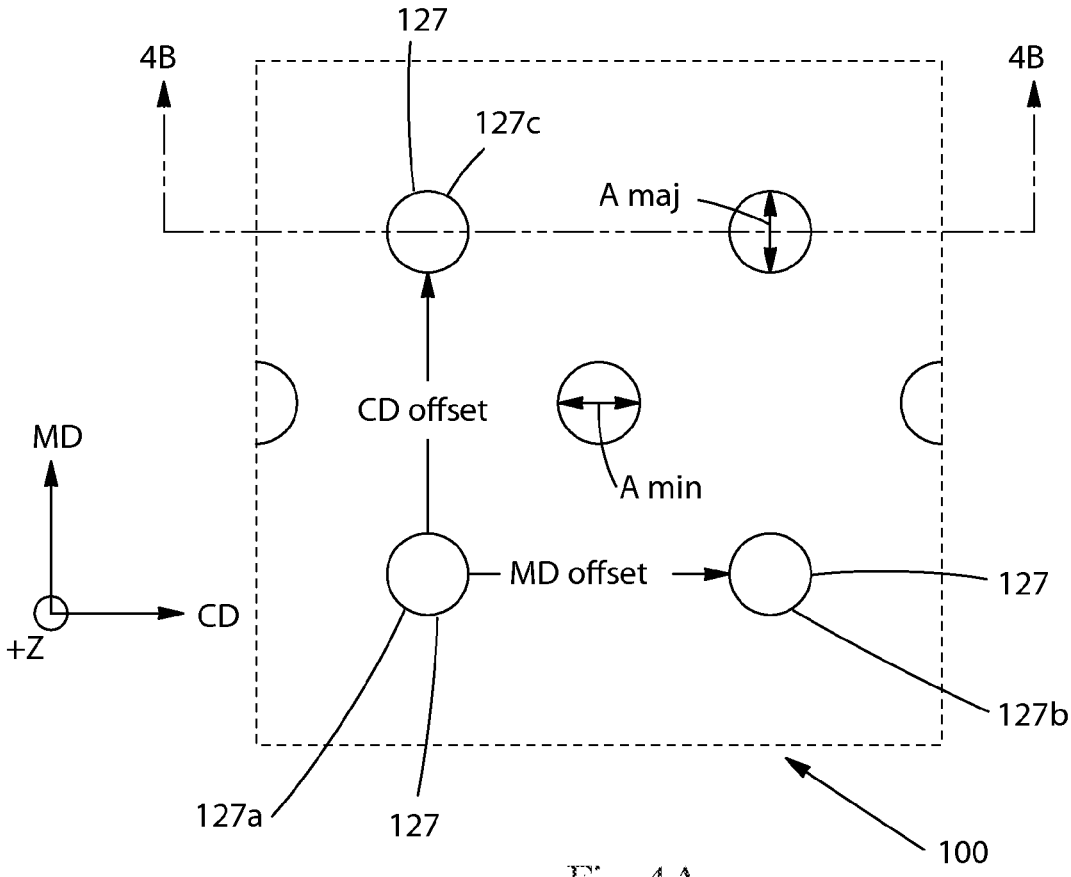
FIG. 4A is a perspective view of an exemplary web stabilization device according to the present invention comprising a plurality of surface features.

FIG. 4A shows a perspective view of an exemplary web stabilization device 100 comprising a plurality of surface features 127. In some embodiments, the surface features 127 may be selected from the group consisting of: round, oblong, curved, circular, the like, and combinations thereof. In another embodiment, the surface features 127 may be recessed into (i.e., have a local minima in the −z direction) the surface of the web stabilization device 100. In another embodiment, the surface features 127 may extend from (i.e., have a local maxima in the +z direction) the surface of the web stabilization device 100. Such extension or recession may be referred to as the feature depth ($D_{feature}$). It is surprisingly discovered that feature depth (extension or recession) has a significant impact on the forces exerted on the web. In one embodiment, the feature depth is greater than about 0.020". In another embodiment, the feature depth is from about 0.020" to about 0.040". In another embodiment, the feature depth is from about 0.020" to about 0.032".

One of skill in the art will appreciate that the surface features 127 of the present invention may be any shape that is suitable for the intended purpose. In one embodiment, the shape of the surface features 127 may be selected from the group consisting of: circles, ovals, diamonds, honeycomb, curved, square, rectangular, triangular, and combinations thereof.

The surface features may be any size that is suitable for the intended application. In the exemplary embodiment, a surface feature 127 may have a major axis, $A_{maj}$, of from about 1/16" to about 1". In another embodiment, the major axis is from about 0.18" to about 0.72". In some embodiments, a surface feature 127 may have a minor axis, $A_{min}$, of from about 1/16" to about 1". In another embodiment, the minor axis is from about 0.18" to about 0.72". A surface feature may be incorporated onto either the first surface 110 or the second surface 120 of the web stabilization device.

In some embodiments, the surface features 127 may be arranged in repeating, or non-repeating, patterns, such that the pattern may be reduced to a repeating unit. In one embodiment, the repeating unit may be described by a grid formation wherein a first surface feature 127*a* is offset from an adjacent surface feature 127*c* in the machine direction (i.e., has an $MD_{offset}$) of from about 0.5 $A_{maj}$ to about 2 $A_{maj}$. In another embodiment, the $MD_{offset}$ is from about 0.2" to about 0.9". In some other embodiments, the surface features 127 may be arranged wherein a first surface feature 127*a* is offset from an adjacent surface feature 127*b* in the cross-machine direction (i.e., has a $CD_{offset}$) of from about 0.5 $A_{min}$ to about 2 $A_{min}$. In one embodiment, the $CD_{offset}$ is from about 0.18" to about 0.72". The surface features 127 may be arranged in a repeating, or a non-repeating, pattern and may occupy the entire first surface 110, or only a portion of the entire first surface 110.

Additional surface features 127 may be positioned in any area between and/or around the surface features arranged described supra. For example, additional surface features 127*d* may be spaced in the halfway between the $MD_{offset}$ and $CD_{offset}$ of the surface features arranged in a grid 127*a,b,c*.

Figure 4B:
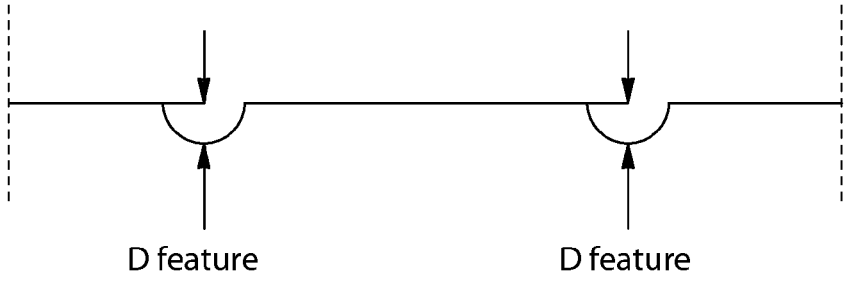
FIG. 4B is a cross-sectional view of the exemplary web stabilization device of FIG. 4A taken along the line 4B-4B.

FIG. 4B is a cross-sectional view of the web stabilization device 100 of FIG. 3A taken along line 4B-4B. As described supra, the surface features 127 may extend from, or be recessed into, the surface of the web stabilization device 100. In the exemplary embodiment shown in FIGS. 3A-B, the surface features 127 are recessed into the surface of the web stabilization device 100. In some embodiments, a surface feature 127 may have a feature depth (i.e., $D_{feature}$, or the longest distance in either the +z-direction or −z-direction from the surface feature 127 to the MD-CD plane of the web-stabilization device) of from about 1/1000" to about 1/5". Surface features 127 may have the same, or different, feature depths/feature heights.

Web Stabilization Device: Positioning Considerations

In addition to velocity, the suction and the aerodynamic drag forces exerted on a moving web and an adjacent object may also be affected by the proximity of the adjacent object (i.e., web stabilization device) to the moving web. Without wishing to be limited by theory, it is thought that the suction and aerodynamic drag forces exerted are inversely proportional to the gap height between the adjacent object and the moving web:

$$F_{areo} \propto 1/h$$

Where $F_{aero}$ represents the suction and aerodynamic drag forces and h is the gap height. Surprisingly, it was discovered that by providing surface features on the exterior of a web-stabilization device, the $F_{aero}$ that is exerted onto the moving web is relatively lower when compared to the $F_{aero}$ exerted by a similar web stabilization device having no surface features.

Present Invention Web Stabilization Device versus Prior Art Web Stabilization Device As discussed supra, the web stabilization devices comprising surface features of the present invention provide a relatively low amount of drag on an adjacent moving web when compared to a web stabilization device having no surface features.

Figure 5A:
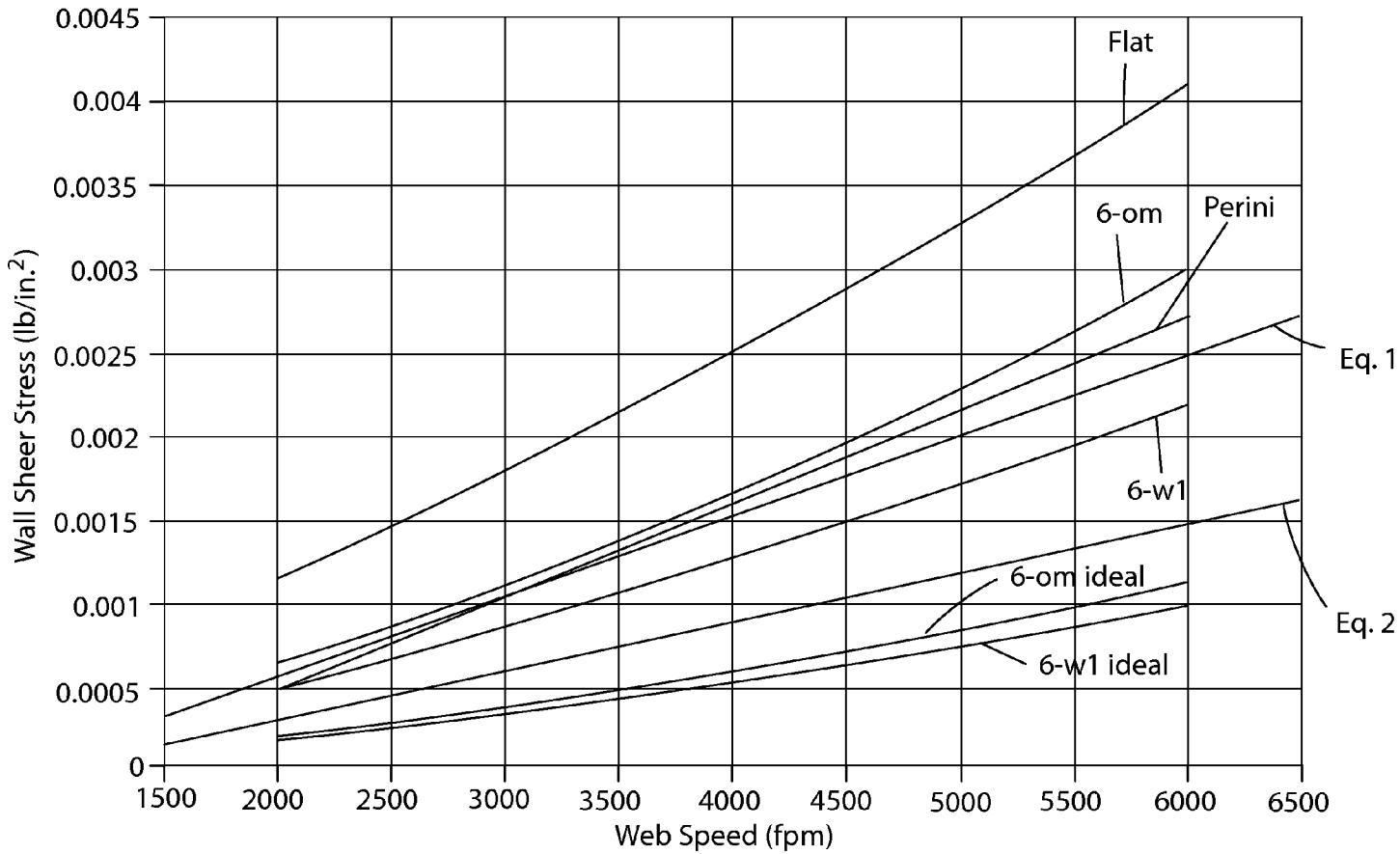
FIG. 5A is a graphical representation of the wall shear stress exerted on a moving web using exemplary web stabilization devices.
Figure 5B:
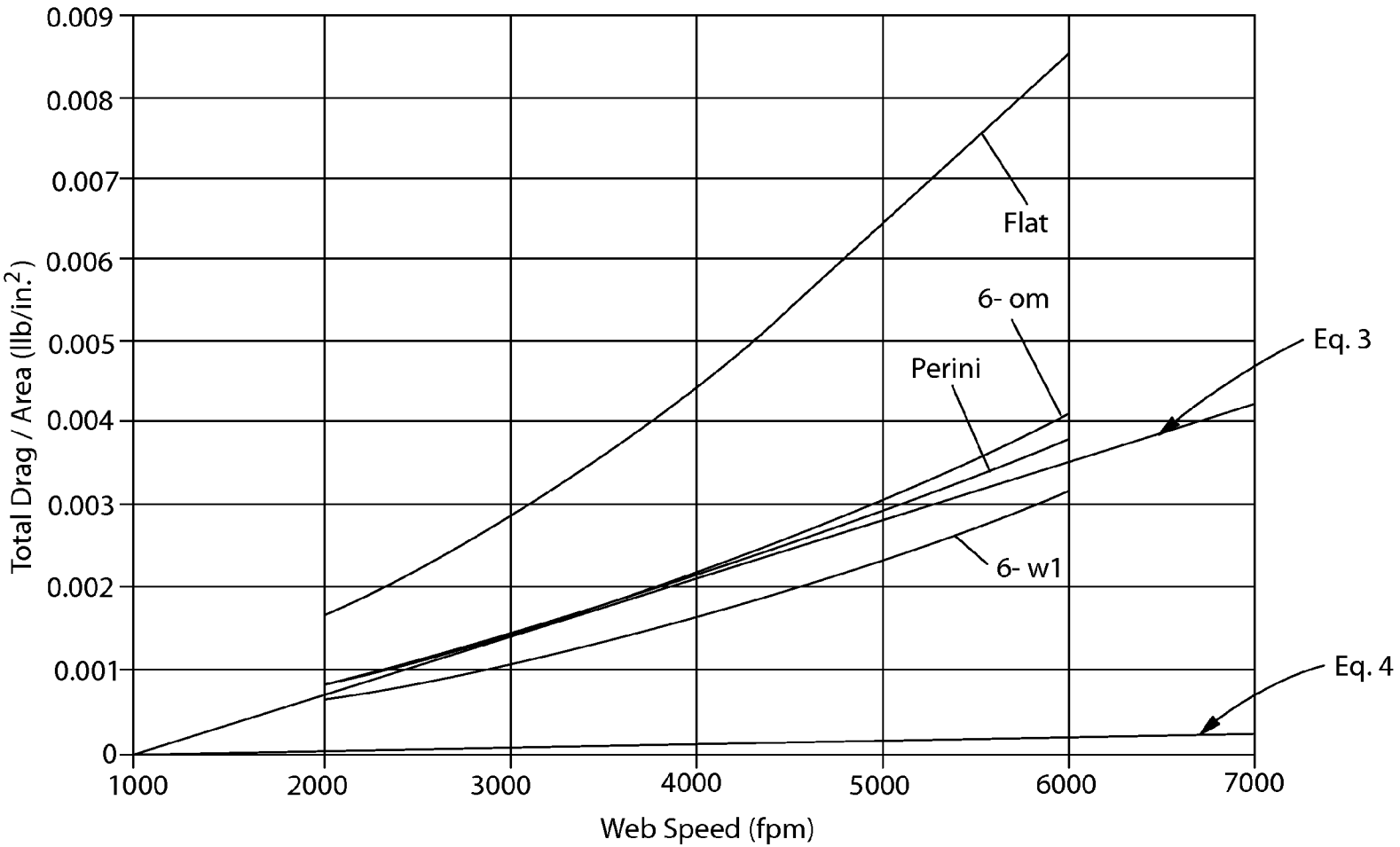
FIG. 5B is a graphical representation of the total drag/area exerted on a moving web using exemplary web stabilization devices.

FIGS. 5A and 5B show a graphical representation of web velocity versus wall shear and total drag/area, respectively, for one prior art (i.e., having no surface features) web stabilization device, a friction-reducing foil (Perini), and two exemplary web stabilization devices having surface features. The drag and shear stress were obtained by a computer model of the exemplary web stabilization devices and a moving web. The method for calculating shear and total drag/area are described in the Drag Modeling Section infra.

The web stabilization devices modeled in FIG. 5 may be described as follows: (1) a web stabilization device having no surface features ("flat plate"); (2) a web stabilization device having surface features which protrude from the MD-CD plane with a $D_{feature}$ of about 0.0145", an $A_{major}$ of about 0.361", an $A_{minor}$ of about 0.190", an $MD_{offset}$ of about 0.450", a $CD_{offset}$ of about 0.360", and with an additional surface feature in the center of the features of a repeating grid ("6-OM"); (3) a commercially available (Fabio Perini S.p.A., Italy) web stabilization device having surface features which protrude from the MD-CD plane with a $D_{feature}$ of about 0.01968", an $A_{major}$ of about 0.393", an $A_{minor}$ of about 0.1181", an $MD_{offset}$ of about 0.4724", a $CD_{offset}$ of about 0.1752", and with an additional surface feature in the center of the features of a repeating grid ("Perini"); (4) and an exemplary present invention web stabilization device having surface features which protrude from the MD-CD plane with a $D_{feature}$ of about 0.032", an $A_{major}$ of about 0.361", an $A_{minor}$ of about 0.180", an $MD_{offset}$ of about 0.450" and a $CD_{offset}$ of about 0.360", and with an additional surface feature in the center of the features of a repeating grid ("6-WL"). One of skill in the art will appreciate that depth may me calculated using a digital caliper, such as those made by Mitutoyo USA (Aurora, Ill.)

Figure 6:
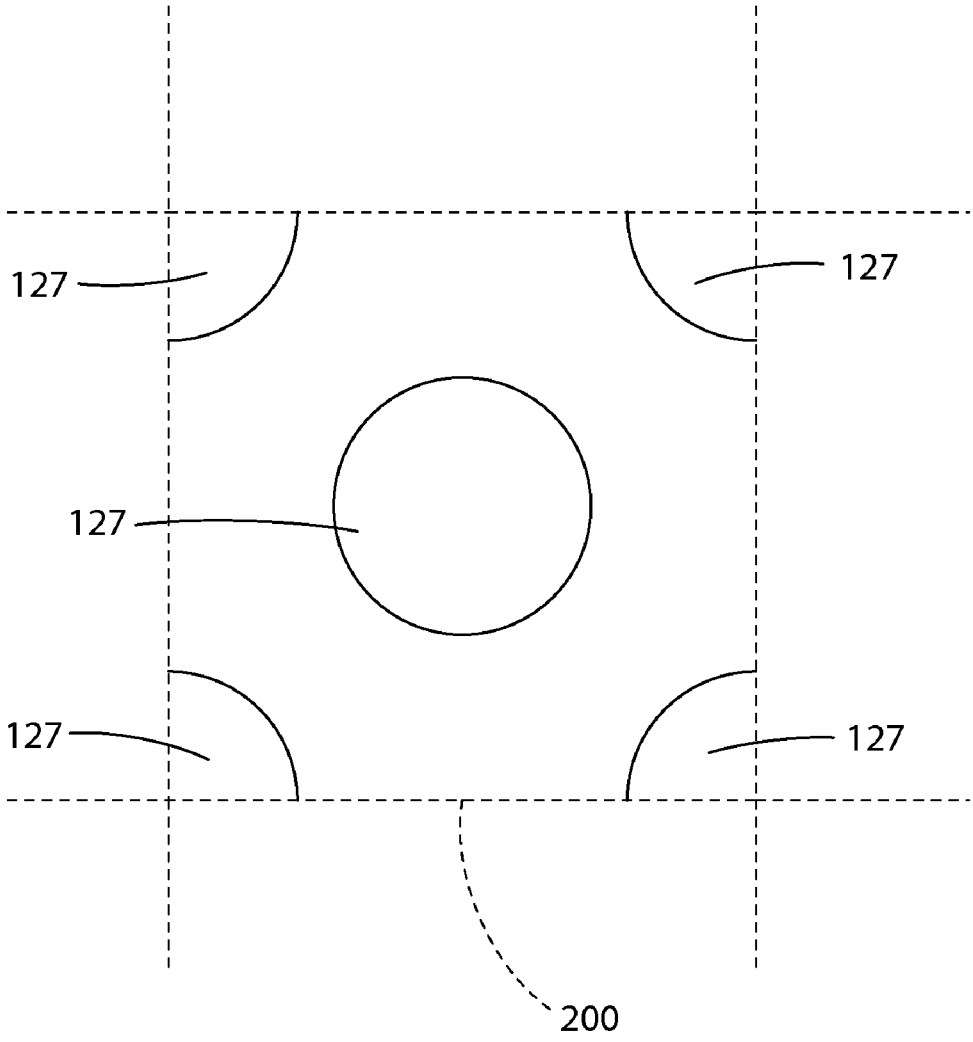
FIG. 6 is a top view of a portion of an exemplary web stabilization device.

The resultant wall shear is described in terms of $lb/in^2$ for velocities of from about 2000 FPM to about 6000 FPM. For the purposes of simulation, the average gap width above the highest point on the web stabilization device is assumed to be 0.001". It is also assumed that there is no direct mechanical friction when aerodynamic drag and suction pressure are computed by the CFD model. However, a mechanical drag force/area is estimated from the computed suction pressure in the web/foil gap and an assumed coefficient of friction. Further, the surface of the web stabilization device is assumed to comprise a repeating pattern of a grid as described supra, and the smallest repeat unit 200 comprising surface features 127 is illustrated in FIG. 6. A constant level of tension in the moving paper web is assumed and the pressure at the MD boundaries (i.e., front and back of the web stabilization device) is assumed to be zero. Symmetry in the CD is also assumed. A coefficient of friction of 0.3 is assumed. The conditions described supra are described as "test system." The test system results are described as an average/web surface area.

The ideal drag and shear are calculated by assuming a situation in which a sheet may be placed at a fixed distance away from the web stabilization device, but without the actual surface features being there. This is used to calculate the lower limit of the wall shear stress.

In one embodiment, the web stabilization device of the present invention provides a test system wall shear stress/area ($lb/in^2$) of less than about the test system wall shear stress calculated by the following relationship (Eq. 1) at velocities of from about 2000 FPM to about 6000 FPM.

$$\text{Wall Shear Stress}=(5\times10^{-7})(\text{Web velocity})-5\times10^{-4} \quad \text{Eq. 1}$$

In another embodiment, the test system wall shear stress is from about the test system wall shear stress calculated by Eq. 1 to the test system wall shear stress calculated by Eq. 2 at velocities of from about 2000 FPM to about 6000 FPM.

$$\text{Wall Shear Stress}=(3\times10^{-7})(\text{Web velocity})-3\times10^{-4} \quad \text{Eq. 2}$$

In one embodiment, the web stabilization device of the present invention provides a test system total drag/area ($lb/in^2$) of less than about the test system total drag/area calculated by the following relationship (Eq. 3) at velocities of from about 2000 FPM to about 6000 FPM.

$$\text{Total Drag}=(7.075\times10^{-7})(\text{Web velocity})-7.45\times10^{-4} \quad \text{Eq. 3}$$

In another embodiment, the test system total drag/area ($lb/in^2$) is from about the web total drag/area calculated by Eq. 3 to the test system total drag/area calculated by Eq. 4 at velocities of from about 2000 FPM to about 6000 FPM.

$$\text{Total Drag}=(4.9975\times10^{-8})(\text{Web velocity}) \quad \text{Eq. 4}$$

Test Methods

The following describe the test methods utilized herein to determine the values consistent with those presented herein.

Drag Modeling Section

One of skill in the art may appreciate that the mechanism of interaction between the web stabilization device and a moving web having a surface structure is complex. Since there is a strong influence by the aerodynamics of this interaction, a computational fluid dynamics (CFD) analysis of the geometries of interest is performed using the Fluent™ CFD software package (Fluent, Inc., Lebanon, N.H.). The following assumptions are made in the analysis:

1. The moving web is perfectly flat and non-porous. Further, it is assumed to be rigid and does not deflect into the recesses of the dimples.
2. There is no mechanical contact and there is about a 0.001" gap between the web stabilization device and the moving web. In a scenario where the surface features protrude from the MD-CD plane of the web stabilization device, the 0.001" gap is measured from the highest points of the surface features.
3. For comparison purposes, a small section of the plates is modeled and inlet and exit flows are assumed to have zero pressure. It requires an extremely large model to consider the actual plate lengths to be included in the model together with the very small dimple geometries that will be many.
4. Symmetric boundary conditions for repeat patterns in the CD.
5. The mesh density is such that the minimum mesh size is about 0.001" for the patterned geometries. For the base flat plate model, the minimum mesh size is assumed to be 0.0001".
6. Moving web has a constant tension.
7. Coefficient of friction is 0.3.
8. Mechanical drag is predicted from the coefficient of friction and suction pressure.

The geometry of the web stabilization foil is first generated in a CAD program and output as a *.sat file. The *.sat file is imported into GAMBIT (Fluent, Inc., Lebanon, N.H.) to generate a 3-D mesh and apply boundary conditions.

The 3-D mesh file is then exported to the Fluent CFD software. An isothermal flow is assumed. The Fluent CFD software is used to iteratively solve the Navier Stokes equations until the solution converges. Using the above parameters, one of skill in the art may use the Fluent CFD software package to solve the Navier-Srokes Equations to provide the wall shear and total drag results.

All measurements referred to herein are made at 25° C. unless otherwise specified. Herein, "comprising" means the term "comprising" and can include "consisting of" and "consisting essentially of."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A papermaking apparatus comprising a machine direction, cross machine direction, and a z-direction, the apparatus further comprising a web stabilization device, wherein the web stabilization device comprises a plurality of recessed surface features disposed upon a surface thereof; wherein each of the plurality of surface features have a feature depth of greater than about 0.02".

2. A papermaking apparatus according to claim 1 further comprising a web.

3. A papermaking apparatus according to claim 2 wherein the web is selected from the group of materials consisting of: polymeric films, fabric, cloth, metal films, nonwovens, airlaid products, and combinations thereof.

4. A papermaking apparatus according to claim 2 wherein the web stabilization device is positioned adjacent the web in the z-direction.

5. A papermaking apparatus according to claim 4 wherein the web stabilization device is positioned above the web.

6. A web stabilization device wherein the web stabilization device comprises a first surface and a second surface, and wherein the web stabilization device further comprises a plurality of recessed surface features disposed upon said first surface, each of said surface features having a feature depth of greater than about 0.02".

7. A web stabilization device according to claim 6 wherein the feature depth is from about 0.02" to about 0.04".

8. A web stabilization device according to claim 6 wherein the surface features further comprise a major axis and a minor axis and wherein the major axis is from about 1/16" to about 1" and wherein the minor axis is from about 1/16" to about 1".

9. A web stabilization device according to claim 8 wherein the major axis is from about 0.19" to about 0.72".

10. A web stabilization device according to claim 8 wherein the minor axis is from about 0.19" to about 0.72".

11. A web stabilization device according to claim 6 further comprising an $MD_{offset}$ and a $CD_{offset}$ wherein the $MD_{offset}$ is from about 0.5 $A_{maj}$ to about 2 $A_{maj}$ and wherein the $CD_{offset}$ is from about 0.5 $A_{min}$ to about 2 $A_{min}$.

12. A web stabilization device according to claim 6 further comprising an $MD_{offset}$ and a $CD_{offset}$ wherein the $MD_{offset}$ is from about 0.2" to about 0.9" and wherein the $CD_{offset}$ is from about 0.19" to about 0.72".

13. A web stabilization device according to claim 6 wherein the first surface is concave.

14. A web stabilization device according to claim 6 wherein the surface features are integral to the first surface and wherein the first surface is convex.

15. A web stabilization device having a plurality of recessed surface features disposed upon a web contacting surface, wherein the web stabilization device provides a test system wall shear stress (lb/in$^2$) of less than about:

$$\text{Wall Shear Stress} = (5\times10^{-7})(\text{Web velocity}) - 5\times10^{-4}$$

to an adjacent web with a web velocity of from about 2000 FPM to about 6000 FPM.

16. A web stabilization device according to claim 15 wherein the web stabilization device provides a test system wall shear stress (lb/in$^2$) of greater than about:

$$\text{Wall Shear Stress} = (3\times10^{-7})(\text{Web velocity}) - 3\times10^{-4}$$

to an adjacent web with a web velocity of from about 2000 FPM and 6000 FPM.

17. A web stabilization device according to claim 16 wherein the web stabilization device provides a test system total drag/area (lb/in$^2$) of less than about:

$$\text{Total Drag} = (7.075\times10^{-7})(\text{Web velocity}) - 7.45\times10^{-4}$$

to an adjacent web with a web velocity of from about 2000 FPM and 6000 FPM.

18. A web stabilization device according to claim 17 wherein the web stabilization device provides a test system total drag/area (lb/in$^2$) of greater than about:

$$\text{Total Drag} = (4.9975\times10^{-8})(\text{Web velocity})$$

to an adjacent web with a web velocity of from about 2000 FPM and 6000 FPM.

19. A web stabilization device according to claim 15 wherein each of said plurality of recessed surface features has a feature depth of greater than about 0.02".

20. A papermaking apparatus according to claim 15 wherein the web is selected from the group of materials consisting of: polymeric films, fabric, cloth, metal films, nonwovens, airlaid products, and combinations thereof

* * * * *